US009685707B2

(12) United States Patent
Crockett, Jr. et al.

(10) Patent No.: US 9,685,707 B2
(45) Date of Patent: Jun. 20, 2017

(54) ACTIVE ELECTRONICALLY SCANNED ARRAY ANTENNA

(75) Inventors: John A. Crockett, Jr., Anaheim, CA (US); James A. Carr, Fountain Valley, CA (US); Rohn Sauer, Los Angeles, CA (US)

(73) Assignee: RAYTHEON COMPANY, Waltham, MA (US)

( * ) Notice: Subject to any disclaimer, the term of this patent is extended or adjusted under 35 U.S.C. 154(b) by 838 days.

(21) Appl. No.: 13/483,404

(22) Filed: May 30, 2012

(65) Prior Publication Data

US 2013/0321228 A1 Dec. 5, 2013

(51) Int. Cl.

| | |
|---|---|
| ***H01Q 13/10*** | (2006.01) |
| ***H01Q 13/08*** | (2006.01) |
| ***H01Q 21/00*** | (2006.01) |
| ***H01Q 21/06*** | (2006.01) |

(52) U.S. Cl.
CPC ..... *H01Q 13/085* (2013.01); *H01Q 21/0006* (2013.01); *H01Q 21/064* (2013.01)

(58) Field of Classification Search
CPC ..... H01Q 21/00
USPC ..... 343/770, 853, 777, 705, 893
See application file for complete search history.

(56) References Cited

U.S. PATENT DOCUMENTS

| | | | | |
|---|---|---|---|---|
| 3,935,548 A | | 1/1976 | Rosenbaum et al. | |
| 4,959,658 A | * | 9/1990 | Collins | H01Q 21/064 343/778 |
| 5,086,304 A | * | 2/1992 | Collins | 343/778 |
| 5,703,599 A | | 12/1997 | Quan et al. | |
| 5,936,579 A | * | 8/1999 | Kapitsyn et al. | 343/700 MS |
| 6,127,984 A | | 10/2000 | Klebe et al. | |
| 6,219,000 B1 | | 4/2001 | McWhirter et al. | |
| 6,388,631 B1 | | 5/2002 | Livingston et al. | |
| 6,480,167 B2 | * | 11/2002 | Matthews | 343/795 |
| 6,600,453 B1 | | 7/2003 | Hadden, IV et al. | |
| 6,653,984 B2 | | 11/2003 | Park et al. | |
| 6,781,554 B2 | | 8/2004 | Lee et al. | |
| 7,109,943 B2 | * | 9/2006 | McCarville et al. | 343/797 |
| 7,315,288 B2 | | 1/2008 | Livingston et al. | |

(Continued)

FOREIGN PATENT DOCUMENTS

| | | |
|---|---|---|
| JP | 63305538 | 12/1988 |
| WO | 2009005912 A1 | 1/2009 |

OTHER PUBLICATIONS

U.S. Appl. No. 13/348,015, filed Jan. 11, 2012, entitled "Low Profile Cavity Backed Long Slot Array Antenna with Integrated Circulators"; R. Yaccarino et al.

(Continued)

*Primary Examiner* — Dameon E Levi
*Assistant Examiner* — Hasan Islam
(74) *Attorney, Agent, or Firm* — Cantor Colburn LLP

(57) ABSTRACT

An antenna is provided and includes a radiator aperture assembly including a plurality of radiator sticks, each radiator stick including a row of radiating elements configured to transmit and receive RF energy and a body having opposite sides, conductive elements coupled to the radiating elements and a plate disposed proximate to the radiator aperture assembly through which the conductive elements extend. Complementary opposite sides of the respective bodies of adjacent radiator sticks and a surface of the plate are configured to form a slot radiator.

20 Claims, 5 Drawing Sheets

(56) References Cited

U.S. PATENT DOCUMENTS

| | | | | |
|---|---|---|---|---|
| 7,417,598 | B2 * | 8/2008 | Navarro | H01Q 21/061 342/368 |
| 7,764,236 | B2 * | 7/2010 | Hill et al. | 343/702 |
| 7,889,147 | B2 * | 2/2011 | Tam et al. | 343/777 |
| 2004/0004580 | A1 * | 1/2004 | Toland | H01Q 13/085 343/893 |
| 2005/0088353 | A1 | 4/2005 | Irion, II et al. | |
| 2005/0264448 | A1 * | 12/2005 | Cox et al. | 343/700 MS |
| 2009/0315802 | A1 * | 12/2009 | Johansen | H01Q 13/085 343/853 |
| 2012/0068906 | A1 * | 3/2012 | Asher | H01Q 21/0025 343/853 |
| 2013/0176186 | A1 | 7/2013 | Yaccarino et al. | |
| 2013/0183913 | A1 | 7/2013 | Tevell et al. | |
| 2013/0321228 | A1 | 12/2013 | Crockett, Jr. et al. | |
| 2015/0002354 | A1 | 1/2015 | Knowles | |

OTHER PUBLICATIONS

Search Report and Written Opinion from EP Application No. 12169888.0 dated Feb. 4, 2013.

Extended European Search Report issued in 13796807.9, mailed Dec. 15, 2015; 8 pages.

International Search Report issued in PCT/US2015/025538 mailed Nov. 26, 2015; 5 pages.

Written Opinion issued in PCT/US2015/025538 mailed Nov. 26, 2015; 6 pages.

Balanis, "Antenna Theory", Proceedings of the IEEE, vol. 80, No. 1, Jan. 1992, 17 pages.

* cited by examiner

ACTIVE ELECTRONICALLY SCANNED ARRAY ANTENNA

BACKGROUND

The subject matter disclosed herein relates to an active electronically scanned array (AESA) antenna and, more particularly, to connector stick packaging for a long slot aperture of a radiator of an AESA antenna.

An active electronically scanned array (AESA) antenna is an antenna including multiple radiators. The relative amplitude and phase of each of the radiators can be controlled so that transmit or receive beams can be electronically steered without the need for physically or mechanically moving the antenna. Such an antenna includes an aperture for transmitting or receiving waves traveling in free space and may include back-end circuitry having electronics modules for generating signals to be transmitted and for processing received signals.

SUMMARY

According to one aspect, an antenna is provided and includes a radiator aperture assembly including a plurality of radiator sticks, each radiator stick including a row of radiating elements configured to transmit and receive RF energy and a body having opposite sides, conductive elements coupled to the radiating elements and a plate disposed proximate to the radiator aperture assembly through which the conductive elements extend. Complementary opposite sides of the respective bodies of adjacent radiator sticks and a surface of the plate are configured to form a slot radiator.

According to another aspect, an antenna is provided and includes a radiator aperture assembly including a plurality of radiator sticks, each radiator stick having conductive elements electrically coupled to circulators and a plate through which the conductive elements of each of the plurality of the radiator sticks are extendible. The radiator aperture assembly and the plate are attachable to one another such that adjacent radiator sticks define chamfered and notched radiator slots extending forwardly from the plate.

According to yet another aspect, an antenna is provided and includes a radiator aperture assembly including a plurality of radiator sticks, each radiator stick having pairs of conductive elements each respectively electrically coupled to one of a pair of mirrored circulators, a plate through which the conductive elements of each of the plurality of the radiator sticks are extendible and a coldwall into which the conductive elements of each of the plurality of the radiator sticks are extendible and connectable with corresponding transmit/receive modules. The radiator aperture assembly and the plate are attachable to one another such that adjacent radiator sticks define radiator slots extending forwardly from the plate.

These and other advantages and features will become more apparent from the following description taken in conjunction with the drawings.

BRIEF DESCRIPTION OF THE DRAWINGS

The subject matter disclosed herein is particularly pointed out and distinctly claimed in the claims at the conclusion of the specification. The foregoing and other features and advantages are apparent from the following detailed description taken in conjunction with the accompanying drawings in which:

The detailed description explains embodiments of the invention, together with advantages and features, by way of example with reference to the drawings.

DETAILED DESCRIPTION

A new or retrofit radiator assembly is provided for use with new or existing antenna arrays as well as other applications that may have relatively wide lattice configurations. Where it is being used as a retrofit radiator assembly, the radiator assembly can serve as a "drop in" replacement for old radiators and thus requires little to no modifications to antenna hardware. Antenna gain, radio frequency (RF) polarization and scanning performance are maintained or improved.

Figure 1:
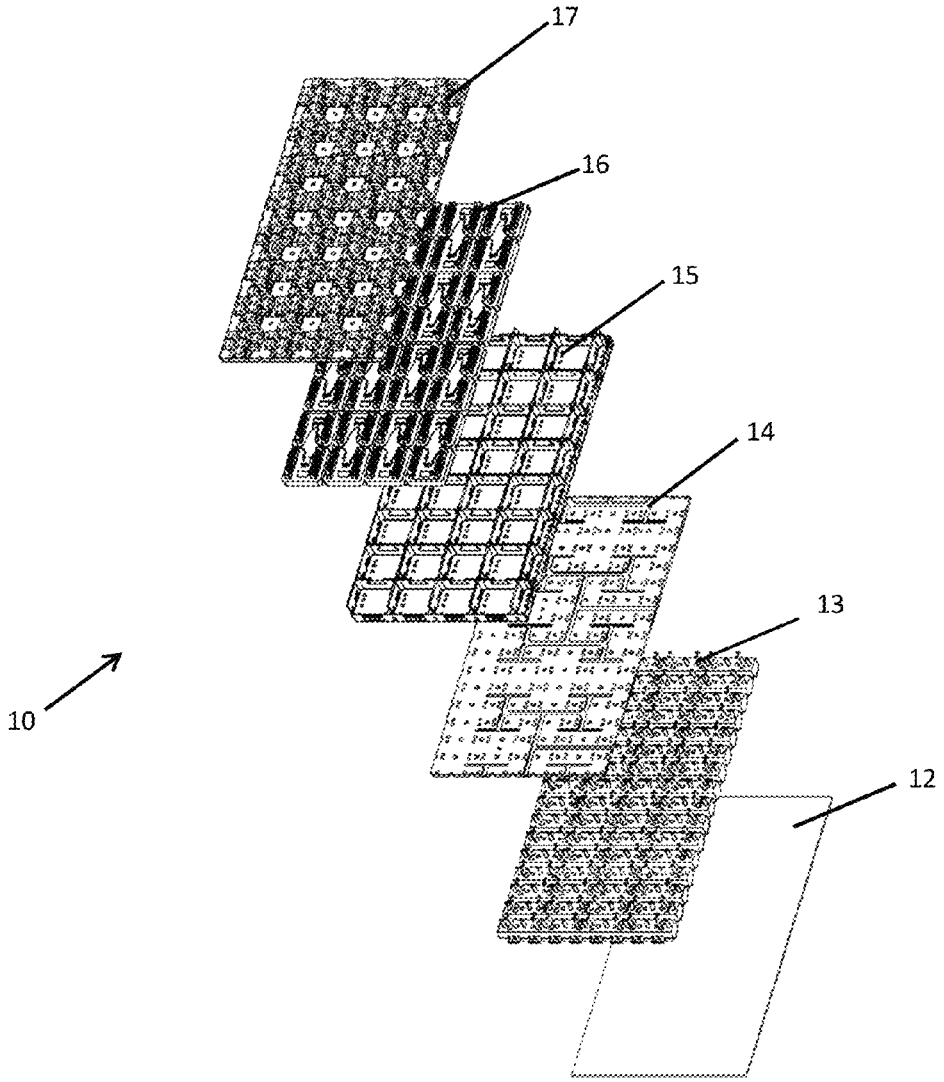
FIG. 1 is a perspective view of an antenna.

With reference to FIG. 1, an active electronically scanned array (AESA) antenna 10 is provided and includes a radome 12, a radiator aperture assembly 13, a plate 14, which serves as a corporate feed or a power divider, a coldwall 15, transmit/receive (T/R) modules 16, a motherboard 17 and an aft cover (not shown). The radome 12 forms a forward end of the antenna 10 whereby electromagnetic radiation is transmitted or received. The aft cover forms an aft end of the antenna 10 in which the T/R modules 16 and the motherboard 17 are disposed to perform certain electronic functions. In particular, the motherboard 17 provides a DC signal and power distribution network by which the T/R modules 16 can be controlled. The radiator aperture assembly 13, the plate 14 and the coldwall 15 are operably disposed between the forward and aft ends of the antenna 10.

As shown in FIG. 1, the antenna 10 as a whole can have a rectangular shape with the radiator aperture assembly 13 having a similarly rectangular shape. This is not required, however, and it is to be understood that the antenna 10 can have various overall shapes with the radiator aperture assembly having similar or different shapes as well.

Figure 2:
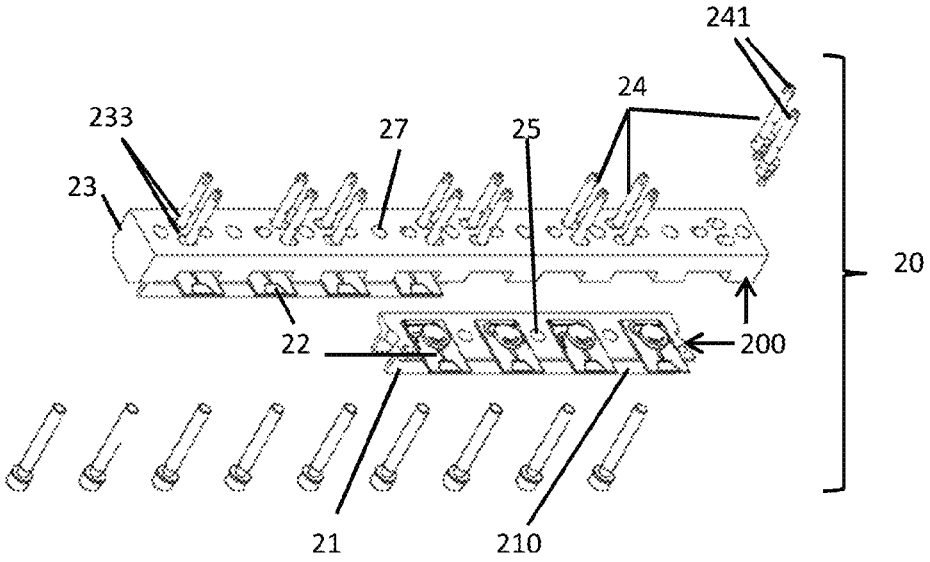
FIG. 2 is a perspective exploded view of a radiator stick of the antenna of FIG. 1.
Figure 3:
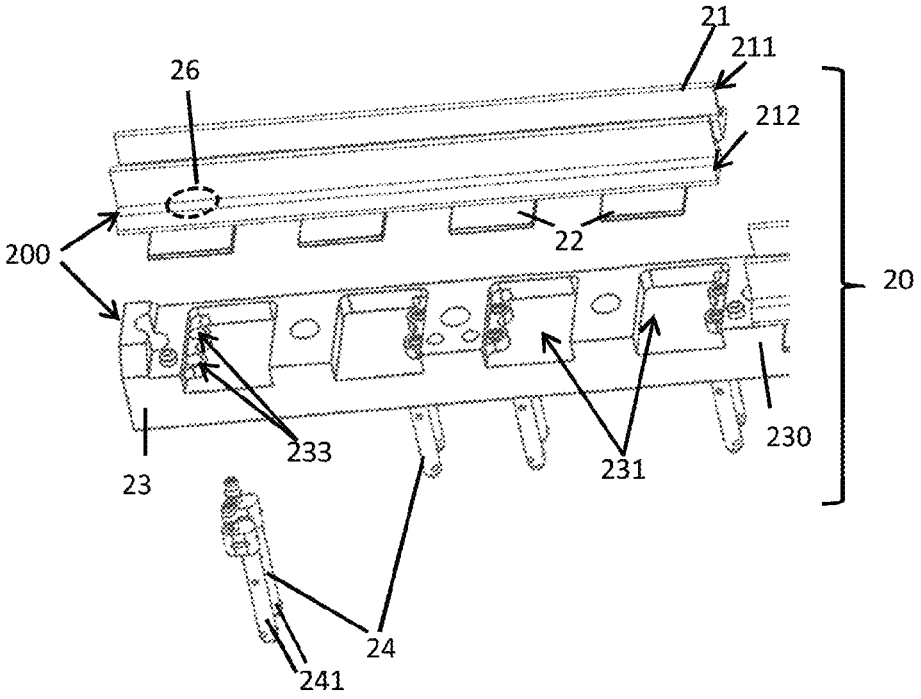
FIG. 3 is a perspective exploded view of a radiator stick of the antenna of FIG. 1.
Figure 4:
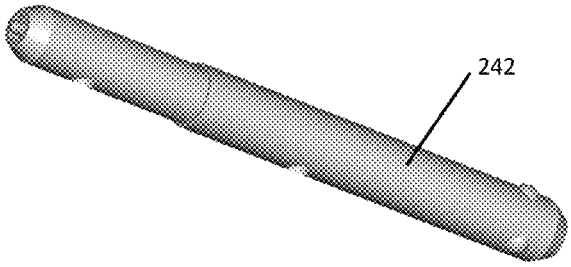
FIG. 4 is a perspective view of a straight coax connector.

With reference to FIGS. 2, 3 and 4, the antenna 10 is assembled in various stages including an initial stage during which a plurality of radiator "sticks" 20 of the radiator aperture assembly 13 are assembled. In accordance with embodiments, each radiator stick 20 includes a body 200 that is formed of a radiator cover 21, a plurality of circulators 22, a radiator base 23 and a plurality of pairs of coax connectors 24. In accordance with embodiments, the pairs of coax connectors 24 may each have two offset coax connectors 241, two straight coax connectors 242 (see FIG. 4) or an offset coax connector 241 and a straight coax connector 242.

Still referring to FIGS. 2 and 3, the radiator cover 21 has a body 210 with a forward section 211 and an aft section 212 (see FIG. 3). The forward section 211 is generally rectangular in cross-section whereas the aft section 212 is frustoconical in cross-section. The forward section 211 is narrower than the narrow end of the aft section 212 while the wide end of the aft section 212 has a substantially similar width as that of the radiator base 23.

A series of substantially circular holes 25 and elongate holes 26 are defined through the radiator cover 21 along a longitudinal length thereof. The substantially circular holes 25 align with corresponding fastener holes 27 of the radiator base 23 such that fastening elements, such as screws, can be threadably inserted to attach the radiator cover 21 to the radiator base 23. The elongate holes 26 permit the plurality of the circulators 22 to be respectively fastened to the radiator cover 21 or the radiator base 23 in accordance with known methods.

The radiator base 23 has a body 230 that is substantially rectangular in cross-section and is formed to define the fastener holes 27 and recesses 231 between sequential fastener holes 27. The fastener holes 27 align with corresponding substantially circular holes 25 and the recesses 231 align with locations of the circulators 22. The body 230 is further formed to define pairs of offset coax connector through holes 233, pairs of straight coax connector through-holes or pairs of a straight coax connector through-hole and an offset coax connector through-hole 233 within each one of the recesses 231. The straight coax connector through-holes and the offset coax connector through holes 233 are located such that they align with corresponding transmission and reception ports 224 and 225 of the circulators 22 (see FIG. 5). Each of the straight coax connector through holes is formed to extend in a generally straight line through the body 230 in accordance with a shape of the straight coax connectors 242. The offset coax connector through holes 233 are each elongated in accordance with a shape of the offset coax connectors 241.

Figure 5:
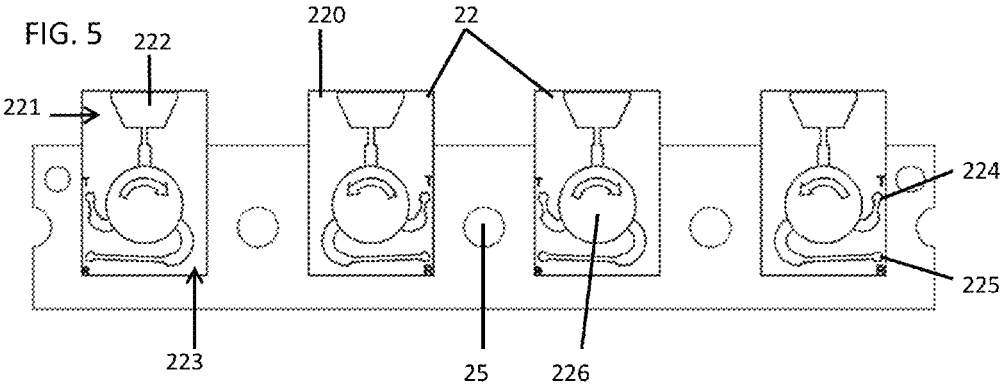
FIG. 5 is a plan view of a plurality of circulators in accordance with embodiments.

With reference to FIG. 5, each of the circulators 22 includes a substrate 220 and a permanent magnet 226. The substrate 220 has a probe portion 221 at which an antenna port 222 is defined and a circulator portion 223 at which the transmission and reception ports 224 and 225 are respectively defined. For each circulator 22, the circulator portion 223 separates outbound waves from inbound waves and routs them from the transmission port 224 or to the reception port 225. The probe portion 221 couples waves traveling in a microstrip transmission line at the antenna port 222 to waves propagating in free space.

When the circulators 22 are fastened to the radiator cover 21, each of the transmission ports 224, the reception ports 225 and the permanent magnets 226 face toward a corresponding one of the recesses 231. Thus, when the radiator base 23 is attached to the radiator cover 21 with the straight coax connectors 242 received in the straight coax connector through-holes and/or the offset coax connectors 241 received in the offset coax connector through-holes 233, the circulators 22 sit within the recesses 231, the coax connectors (straight or offset) electrically couple with the transmission ports 224 and/or the reception ports 225.

In accordance with alternative embodiments, it is to be understood that the circulators 22 may be fastened to the radiator cover 21 as noted above or to the radiator base 23.

Figure 6:
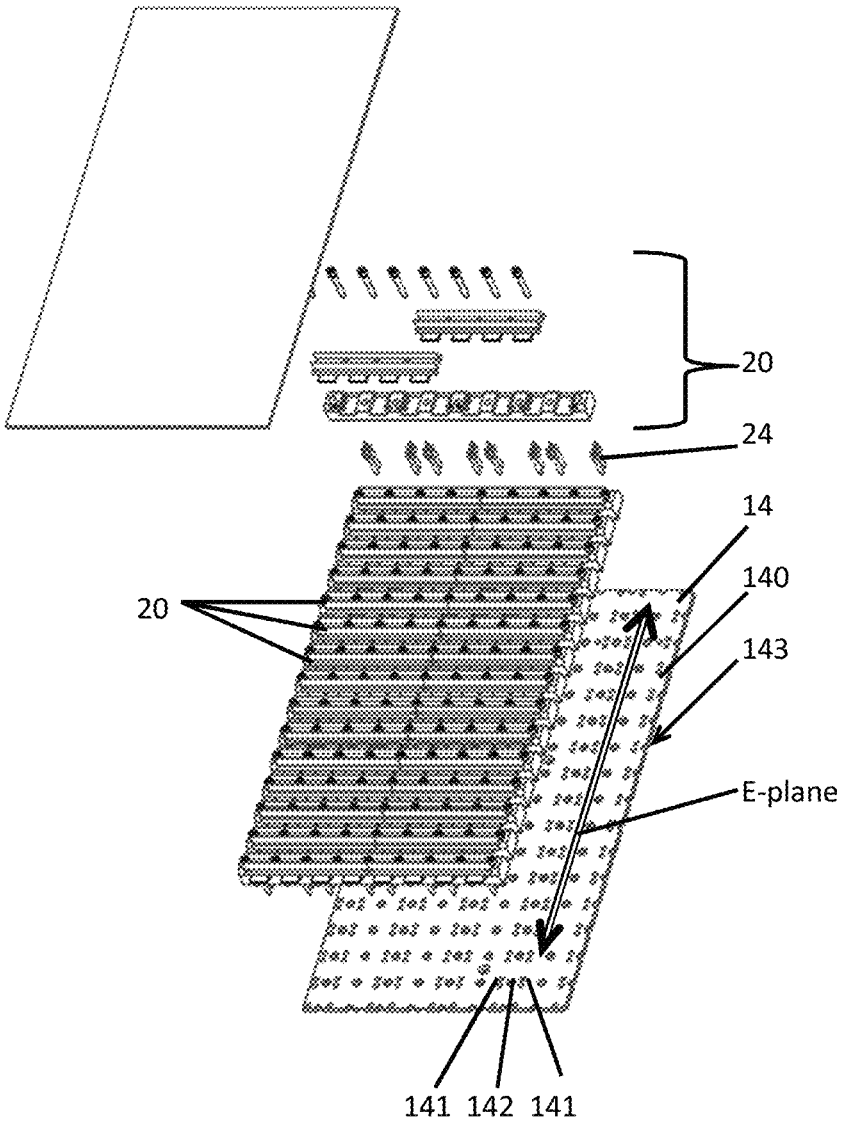
FIG. 6 is a perspective view of a plurality of radiator sticks and a plate to which the radiator sticks are coupled.

With reference to FIG. 6, a plurality of radiator sticks 20 may be formed as described above and subsequently installed onto the plate 14 during a second stage of the antenna 10 assembly process. As shown in FIG. 4, the plate 14 has a generally planar body 140 with at least one planar surface 143 in which pairs of transmission and reception holes 141 and additional fastener holes 142 are formed. When the plurality of the radiator sticks 20 are installed onto the plate 14, the straight coax connectors 242 and the offset coax connectors 241 are extendible through the transmission and reception holes 141 while the additional fastener holes 142 align with the corresponding fastener holes 27 and the corresponding circular holes 25 such that the fastening elements that attach the radiator cover 21 to the radiator base 23 can also attach the radiator sticks 20 to the plate 14. The radiator sticks 20 are installed with an orthogonal orientation relative to the E-plane of the plate 14, which provides for advantages that will be discussed in detail below.

A first advantage is that the radiator sticks 20 permit attachment of a number of coax connectors with the plate 14 that is small enough (i.e., less than 1000s of simultaneous connections) to be achievable and large enough (i.e., more than 1 connection at a time) to be efficient. A second advantage is that the radiator sticks 20 extend along a long direction of the plate 14, which allows for an increased number of coax connections per radiator stick 20. A third advantage is that the arrangement of the transmission and reception holes 141 around the additional fastener holes 142 permits a mirrored arrangement of the circulators 22.

That is, with reference to FIG. 5, it is seen that a pair of circulators 22 may be provided on either side of a circular hole 25 (such that the circulators 22 would also be provided on either side of a fastener hole 27 and an additional fastener hole 142). The circulator 22 on the left side of the circular hole 25 in FIG. 5 has a permanent magnet 226 of a first polarity with a transmission port 224 and a reception port 225 proximate to the circular hole 25. By contrast, the circulator 22 on the right side of the circular hole 25 in FIG. 5 has a permanent magnet 226 of a second polarity, which is opposite the first polarity, with a transmission port 224 and a reception port 225 similarly proximate to the circular hole 25.

Figure 7:
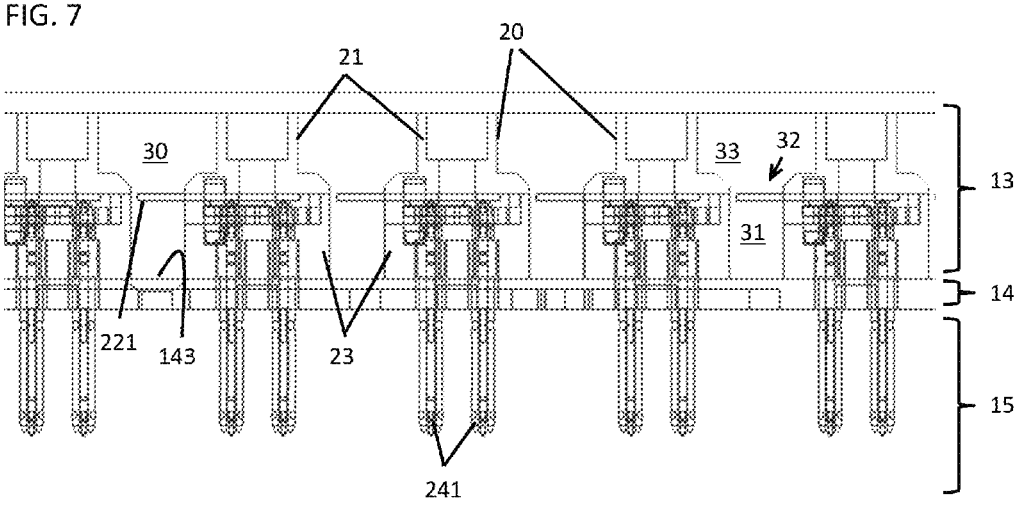
FIG. 7 is a plan view of a radiator aperture assembly, a plate and a coldwall.

With reference to FIG. 7, once the radiator sticks 20 are installed onto the plate 14, the plate 14 may be connected with the coldwall 15. The coldwall 15 includes circuitry for connection to each of the straight coax connectors 242 and each of the offset coax connectors 241. This circuitry is itself configured for electrical coupling with corresponding circuitry of the T/R modules 16.

As shown in FIG. 7, the planar surface 143 of the plate 14 and complementary opposite sides of the radiator cover 21 and the radiator base 23 of each pair of adjacent radiator sticks 20 cooperatively form a long radiator slot 30 that extends forwardly away from the surface 143 of the plate 14. The respective probe portion 221 of each circulator 22 extends into the radiator slot 30 formed adjacent to its corresponding radiator stick 20 such that the corresponding antenna port 222 (see FIG. 5) can interact with waves propagating in the free space. Due to the shape of the radiator cover 21 and the radiator base 23, as described above, each radiator slot 30 has a straight, relatively narrow aft portion 31 through which the probe portions 221 partially extend, a chamfered and notched portion 32 just forward from the probe portions 221 and a straight, relatively wide forward portion 33.

The straight, relatively narrow aft portion 31 has a substantially uniform width with increasing distance forward from the surface 143. The probe portions 221 partially extend through a forward end of the straight, relatively narrow aft portion 31 such that distal ends of the probe portions 221 are slightly displaced from a side of the adjacent radiator base 23. The chamfered and notched portion 32 is formed just forward from the probe portions 221 and is defined by the effective chamfering and notching of the aft section 212 of the radiator cover 21, which has the frusto-conical cross-section. The straight, relatively wide forward portion 33 is wider than the straight, relatively narrow aft portion 31 and has a substantially uniform width with increasing distance forward from the surface 143.

The shape of the slots 30 leads to reduced RF losses and improves antenna gain. These reduced RF losses and improved antenna gain represent another advantage of the configuration described herein.

With reference to FIG. 5, it is to be understood that each coax connector may be provided as an offset coax connector 241 or a straight coax connector 242 in offset pairs, straight pairs or mixed pairs. In each case, the radiator base 23 is formed to define offset coax connector through-holes 233 or straight coax connector through-holes as required and the configurations of the transmission and reception ports 224, 225 of the circulators 22 are correspondingly modified. The determination of which configuration is to be used may be made in accordance with various factors, such as costs and the type of antenna array being employed (i.e., the HTM-4, F-15, RACR and APG-79 International module configurations and ISR platforms).

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments have been described, it is to be understood that aspects may include only some of the described embodiments. Accordingly, the invention is not to be seen as limited by the foregoing description, but is only limited by the scope of the appended claims.

The invention claimed is:

1. An antenna, comprising:

a radiator aperture assembly including a plurality of radiator sticks arrayed side-by-side in a first direction, each radiator stick being elongate in a second direction transverse to the first direction and including a row of radiating elements configured to transmit and receive RF energy and a body having opposite sides, the row being extended along the second direction and each of the radiating elements being elongate in the first direction;

conductive elements coupled to the radiating elements; and a plate disposed proximate to the radiator aperture assembly through which the conductive elements extend, complementary opposite sides of the respective bodies of adjacent radiator sticks and a surface of the plate being configured to form a slot radiator that is elongate in the second direction and into which corresponding ones of each of the radiating elements are disposed to extend in the first direction.

2. The antenna according to claim 1, wherein the slot radiator comprises:

a planar surface at the surface of the plate;

a narrow aft portion proximate to the surface of the plate;

a wide forward portion remote from the surface of the plate; and a chamfered and notched portion defined between the narrow aft and wide forward portions, wherein the planar surface, the narrow aft portion, the wide forward portion and the chamfered and notched portion are each elongate in the second direction.

3. The antenna according to claim 2, wherein each of the narrow aft portion and the wide forward portion has a substantially uniform thickness between the complementary opposite sides of the respective bodies of the adjacent radiator sticks.

4. The antenna according to claim 3, wherein the chamfered and notched portion has a narrow aft end, which has a substantially similar thickness as the narrow aft portion, and a wide end that widens laterally.

5. The antenna according to claim 1, wherein the radiating elements comprise circulators that are extendible in the first direction through a corresponding one of the complementary opposite sides of the respective bodies of the adjacent radiator sticks into the slot radiators.

6. The antenna according to claim 5, wherein adjacent pairs of the circulators are mirrored.

7. The antenna according to claim 1, wherein the radiator sticks have an orthogonal orientation with respect to an E-plane of the plate.

8. The antenna according to claim 1, wherein the conductive elements comprise pairs of offset conductive elements.

9. The antenna according to claim 1, wherein the conductive elements comprise pairs of offset conductive elements, pairs of straight conductive elements or mixed pairs of offset and straight conductive elements.

10. The antenna according to claim 1, wherein the plate is formed to define fastener holes and opposite pairs of transmission holes on either side of each of the fastener holes.

11. An antenna, comprising:

a radiator aperture assembly including a plurality of radiator sticks arrayed side-by-side in a first direction, each radiator stick being elongate in a second direction transverse to the first direction and having conductive elements electrically coupled to circulators, the conductive elements being arrayed along the second direction and respectively elongate in the first direction and; and a plate through which the conductive elements of each of the plurality of the radiator sticks are extendible, the radiator aperture assembly and the plate being attachable to one another such that adjacent radiator sticks define chamfered and notched radiator slots extending forwardly from the plate and elongate in the second direction.

12. The antenna according to claim 11, wherein each of the radiator sticks comprises:

a radiator cover having an aft portion with a frusto-conical cross-section and a forward portion with a rectangular cross-section; and a radiator base having a rectangular cross-section.

13. The antenna according to claim 11, wherein each radiator slot includes:

a straight, relatively narrow aft portion;

a chamfered and notched portion just forward from the straight, relatively narrow aft portion; and a straight, relatively wide forward portion, wherein the aft portion, the chamfered and notched portion and the forward portion are each elongate in the second direction.

14. The antenna according to claim 11, wherein each radiator stick comprises pairs of offset conductive elements.

15. The antenna according to claim 11, wherein each radiator stick comprises pairs of offset conductive elements, pairs of straight conductive elements or mixed pairs of straight and offset conductive elements.

16. The antenna according to claim 11, wherein adjacent pairs of the circulators are mirrored.

17. The antenna according to claim 11, wherein the plate is formed to define fastener holes and opposite pairs of transmission holes on either side of each of the fastener holes.

18. An antenna, comprising:

a radiator aperture assembly including a plurality of radiator sticks arrayed side-by-side in a first direction, each radiator stick being elongate in a second direction transverse to the first direction and having pairs of conductive elements each respectively electrically coupled to one of a pair of mirrored circulators, the pair of conductive elements being arrayed along the second direction and each conductive element being elongate in the first direction and;

a plate through which the conductive elements of each of the plurality of the radiator sticks are extendible; and a coldwall into which the conductive elements of each of the plurality of the radiator sticks are extendible and connectable with corresponding transmit/receive modules;

the radiator aperture assembly and the plate being attachable to one another such that adjacent radiator sticks define radiator slots extending forwardly from the plate and elongate in the second direction.

19. The antenna according to claim 18, wherein the pairs of conductive elements comprise for each circulator pairs of offset conductive elements, pairs of straight conductive elements, or mixed pairs of straight and offset conductive elements.

20. The antenna according to claim 18, wherein the radiator slots are chamfered and notched.

* * * * *